US005201670A

United States Patent [19]

Watanabe et al.

[11] Patent Number: 5,201,670

[45] Date of Patent: Apr. 13, 1993

[54] CONNECTORS

[75] Inventors: Tamio Watanabe; Masanori Tsuji; Takayoshi Endo; Sakai Yagi, all of Shizuoka, Japan

[73] Assignee: Yazaki Corporation, Japan

[21] Appl. No.: 797,949

[22] Filed: Nov. 26, 1991

[30] Foreign Application Priority Data

Nov. 30, 1990 [JP] Japan ..... 2-128199[U]

[51] Int. Cl.[5] ..... H01R 13/00

[52] U.S. Cl. ..... 439/372

[58] Field of Search ..... 292/DIG. 49, 246, 247; 439/310, 299, 345, 372, 259, 263, 268

[56] References Cited

U.S. PATENT DOCUMENTS

| | | | |
|---|---|---|---|
| 1,390,105 | 9/1921 | Erwin | 292/247 |
| 1,493,969 | 5/1924 | Dodge | 292/247 |
| 3,629,791 | 12/1971 | Normann | 439/310 |
| 3,930,704 | 1/1976 | Dekanic | 439/263 X |

*Primary Examiner*—Joseph H. McGlynn

*Attorney, Agent, or Firm*—Wigman & Cohen

[57] ABSTRACT

A pair of electrical connectors for releasably connecting a first terminal with a second terminal, comprises: a first connector having a first terminal; a second connector having the second terminal; a manual lever having a base end so mounted on the first connector as to be rotatable in a plane parallel to an insertion direction of the first connector into the second connector, and a free end; an engaging arm provided with a base end rotatably mounted on an intermediate portion of the lever and a free end formed into an engaging portion; engaging means including a hook for catching the engaging portion of the arm, an abutting portion on which the engaging portion of the arm abuts, the hook and abutting portion being provided in the second connector as to be releasably engaged with the engaging portion of the arm. In a preferred embodiment, the connectors further include a spring member for biasing these connectors during connection so as to be separated from each other in the insertion direction described above.

6 Claims, 6 Drawing Sheets

CONNECTORS

BACKGROUND OF THE INVENTION

1. Field of the Invention

The present invention relates to a pair of soft-shell connectors consisting of a male connector and a female connector, and more particularly to the connectors in which the female connector is provided with a manual operating lever which enables a user to easily connect and disconnect the connectors with a small force.

2. Description of the Prior Art

For example, conventional soft-shell connectors of this type are shown in FIG. 1, which are disclosed in detail in Japanese Utility Model Laid-Open Publication (Kokai) No. 63-2375.

As shown in FIG. 1, such conventional connectors consist of a male connector M and a female connector F which is provided with a manual operating lever 7. The lever 7 has its base-end portion 7*a* mounted rotatably in a mounting portion 8 of a main body 6 of the female connector F, and has its free-end portion 7*b* formed into an operating portion 7*b* which is swingable toward the male connector M. Also provided in the female connector F is a ring-like insertion or engaging arm 11 which has: one of opposite ends (pivotal point) 11*a* thereof mounted rotatably in a substantially intermediate portion of the operating lever 7; and the other or free end thereof formed into a engaging portion 11*b* which may engage with a corresponding engaging portion 10 of the male connector M.

The female connector F is further provided with projecting parts 6*b*, 6*c* in its front-end portion. As is clear from FIG. 1, these projecting parts 6*b*, 6*c* of the female connector F are disposed between the pivotal point 11*a* and a engaging portion 11*b*. As described above, the male connector M is provided with the engaging portion 10 which may engage with the engaging portion 11*b* of the insertion or engaging arm 11.

In general, in multi-contact connectors provided with a plurality of terminals, a large effort is required to connect or disconnect them. On the other hand, by the provision of the manual operating lever 7 as shown in FIG. 1, it is possible to connect the above-mentioned conventional connectors (which is provided with the lever 7) with less effort. However, the above conventional connectors provided with the lever 7 still requires a large effort when they are disconnected or separated from each other, because the lever 7 can not act during such separation. In addition, there is a fear that such large effort to separate the connectors from each other often causes serious damage of the connectors.

SUMMARY OF THE INVENTION

It is an object of the present invention to provide a pair of soft-shell connectors consisting of a male connector and a female connector provided with a manual operating lever which enables a user to easily connect and disconnect the connectors.

These and other objects of the present invention is accomplished by providing:

a pair of connectors for electrically connecting a first terminal with a second terminal which are electrically connected with their corresponding wires, comprising:

a first connector holding the first terminal;

a second connector being connected with the first connector in a detachable manner, holding the second terminal which is connected with the first terminal in a detachable manner;

a manual operating lever for connecting and disconnecting the first connector and the second connector, provided with a base-end portion and a free-end portion, the base-end portion being so mounted on the first connector as to be rotatable in a plane parallel to a direction in which the first connector is so moved as to be inserted into the second connector;

an engaging arm provided with a base-end portion and a free-end portion formed into an engaging portion, the base-end portion of the engaging arm being rotatably mounted on the manual operating lever in an intermediate portion of the manual operating lever between the base-end portion of the manual operating lever and the free-end portion of the manual operating lever; and engaging means for being releasably engaged with the engaging portion of the engaging arm, being provided in the second connector; the engaging means including a hook portion for catching the engaging portion of the engaging arm, and an abutting portion on which the engaging portion of the engaging arm abuts.

Since the connectors of the present invention has the above construction, it is possible for the user to easily perform connection and disconnection of the connectors of the present invention with less effort by the use of the manual operating lever.

Further, in case that the biasing means is provided in a bottom wall of one of the connectors of the present invention, a biasing force exerted by the biasing means keeps the connectors parallel to each other during connection operation thereof. On the other hand, in disconnection operation of the connectors, such biasing force enables the user to easily perform disconnection of the connectors with less effort.

The above object, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, the present invention will be described in detail with reference to the accompanying drawings.

A first embodiment of the soft-shell type connectors of the present invention provided with a manual operating lever 29 is shown in FIGS. 2 to 6.

Figure 1:
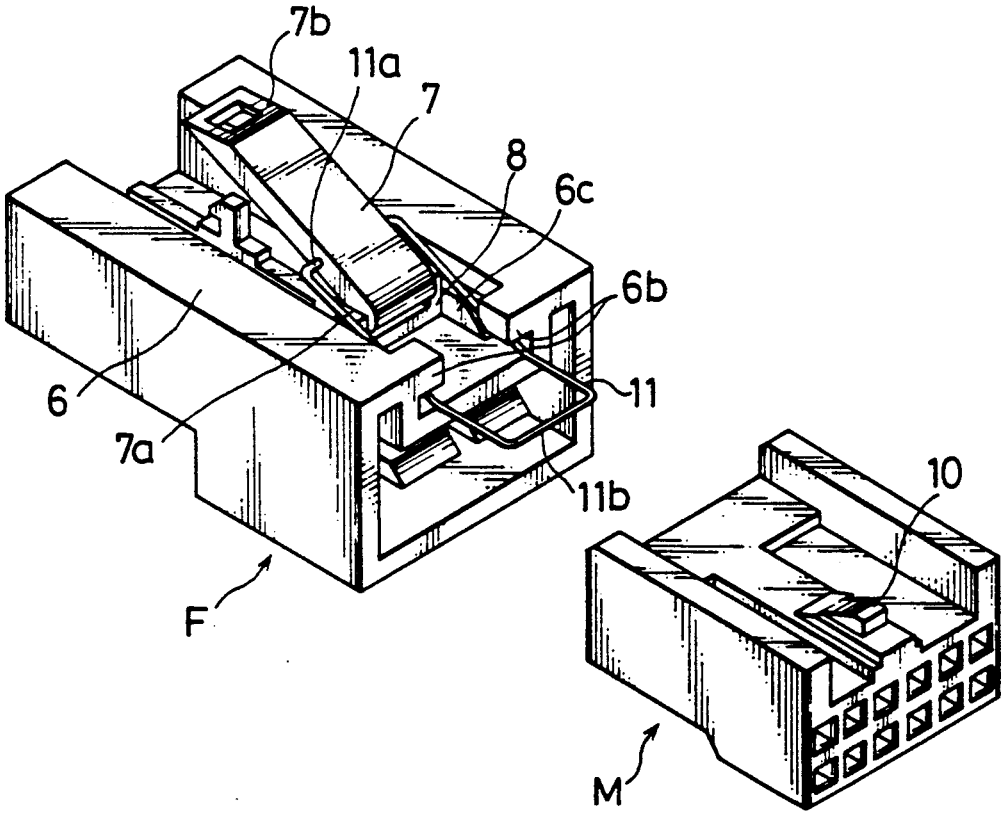
FIG. 1 PRIOR ART
FIG. 1 is a perspective view of the conventional connectors of soft-shell type provided with the manual operating lever.
Figure 2:
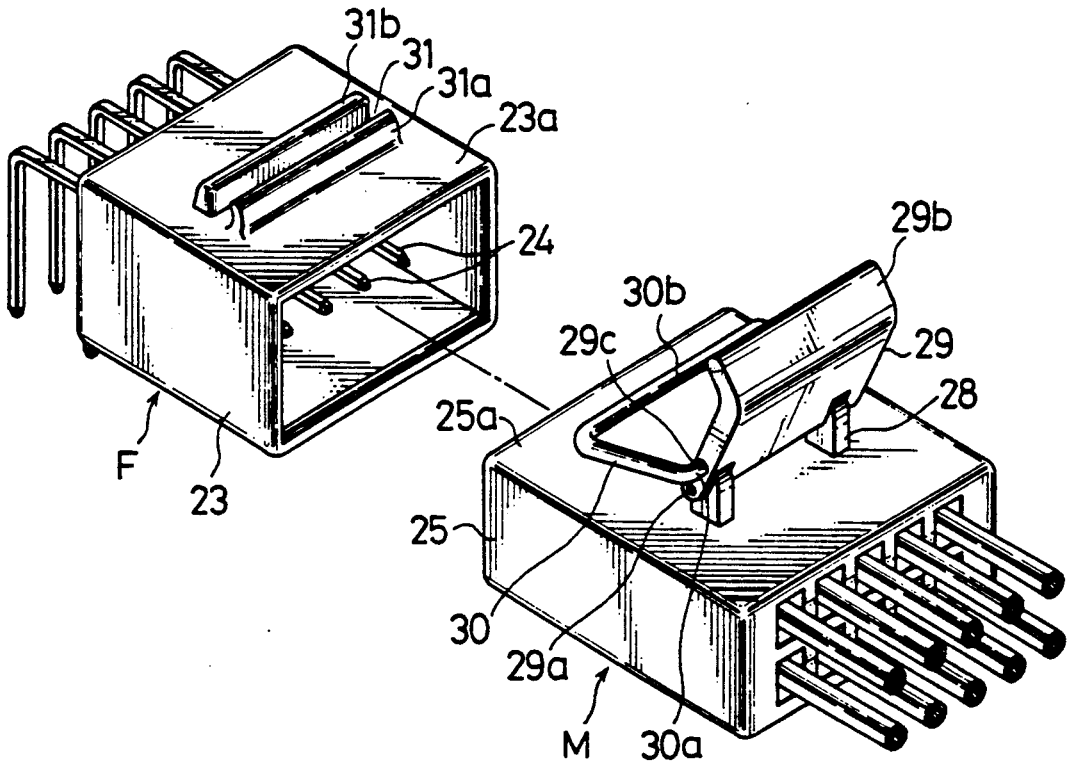
FIG. 2 is a perspective view of a first embodiment of the pair of soft-shell type connectors of the present invention provided with the manual operating lever.
Figure 3:
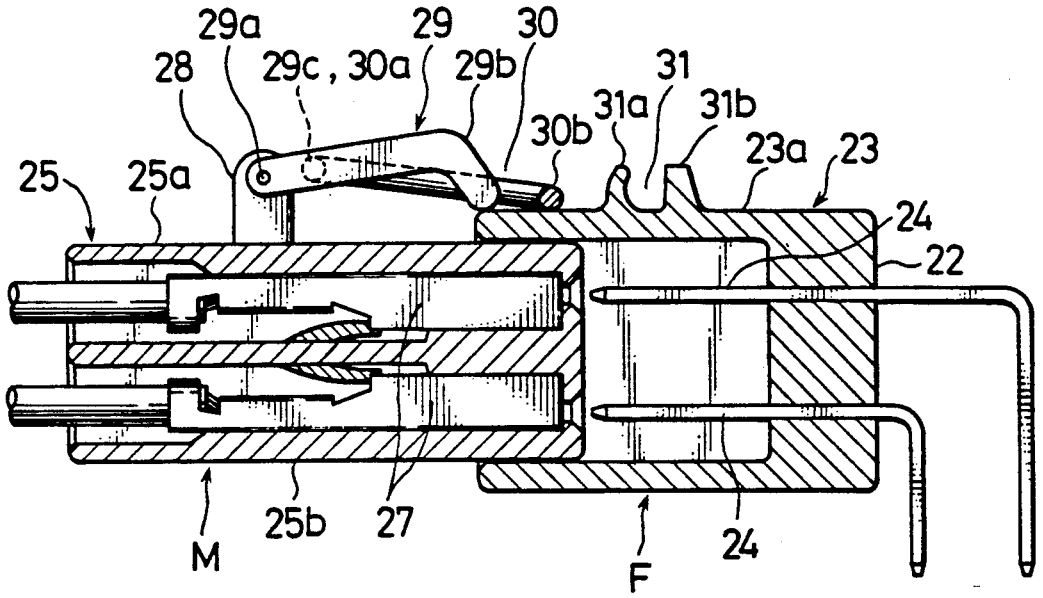
FIG. 3 is a longitudinal sectional view of the connectors of the present invention, take along a vertical plane as viewed in FIG. 2.

As shown in FIG. 2, the connectors of the present invention consist of a male connector M and a female connector F which is provided with a hood portion 23 defining a receiving space for receiving the male connector M therein. A plurality of male terminals 24 are fixedly mounted in the bottom of the hood portion 23 of the female connector F so as to extend leftward from the bottom as viewed in FIG. 3.

On the other hand, the male connector M is provided with a plurality of female terminals 27 therein. These female terminals 27 of the male connector M are connected with the male terminals 24 of the female connector F in a detachable manner. Further, the male connector M is provided with a peripheral wall 25 having an upper surface 25*a* and a lower surface 25*b*.

A pair of mounting portions 28 provided with through-holes (not shown) are provided in the upper surface 25*a* of the peripheral wall 25 of the male connector M. A manual operating lever 29 has its axle portions 29*a* mounted rotatably in these through-holes of the mounting portions 28 of the male connector M so that the lever 29 are swingable round the through-holes of the mounting portions 28 of the male connector M.

A free-end portion of the operating lever 29 is formed into an operating portion 29*b*. In addition, a ring-like engaging arm 30, which is provided with an engaging portion 30*b*, has its opposite ends 30*a* mounted rotatably in a pair of holes 29*c* formed in an intermediate portion of the operating portion 29*b* thereof. On the other hand, formed in an upper surface 23*a* of the hood portion 23 of the female connector F are: a projection formed into a hook projection 31*a*; and another projections formed into an abutting projection 31*b* for facilitating disconnection of the connectors F, M. Consequently, as is clear from FIG. 2, a groove 31 is formed between the hook projection 31*a* and the abutting projection 31*b* of the female connector F so as to be adapted to releasably receive the engaging portion 30*b* of the engaging arm 30 therein during connection of the connectors F, M.

Figure 4C:
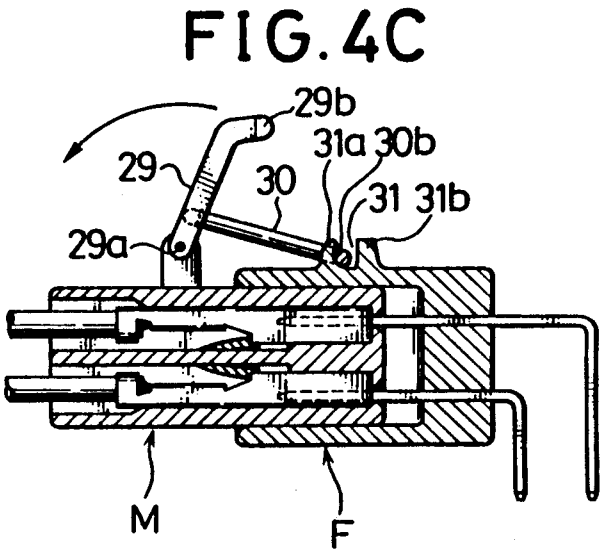
FIGS. 4A, 4B, 4C and 4D are views similar to FIG. 3, illustrating connection operation of the connectors of the present invention shown in FIG. 2.

In connecting operation of the connectors F, M, as shown in FIG. 2, first, the male connector M is oppositely disposed from an opening of the hood portion 23 of the female connector F. Then, as shown in FIG. 4A, the male connector M is gradually inserted into the hood portion 23 of the female connector F in a condition in which the engaging portion 30*b* of the engaging arm 30 has been moved slightly upward to prevent the engaging portion 30*b* from abutting on the hook projection 31*a* of the female connector F.

Figure 4D:
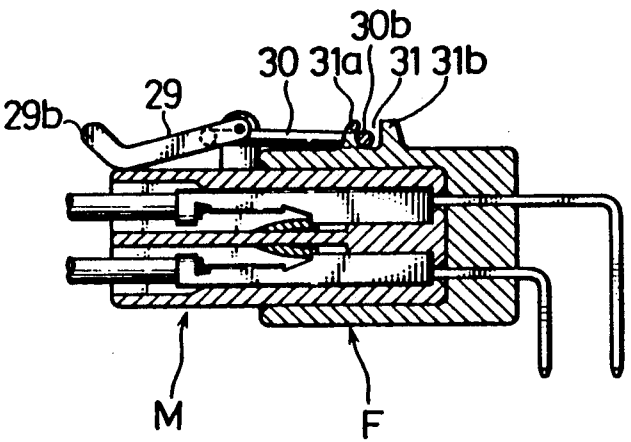
Figure 4A:
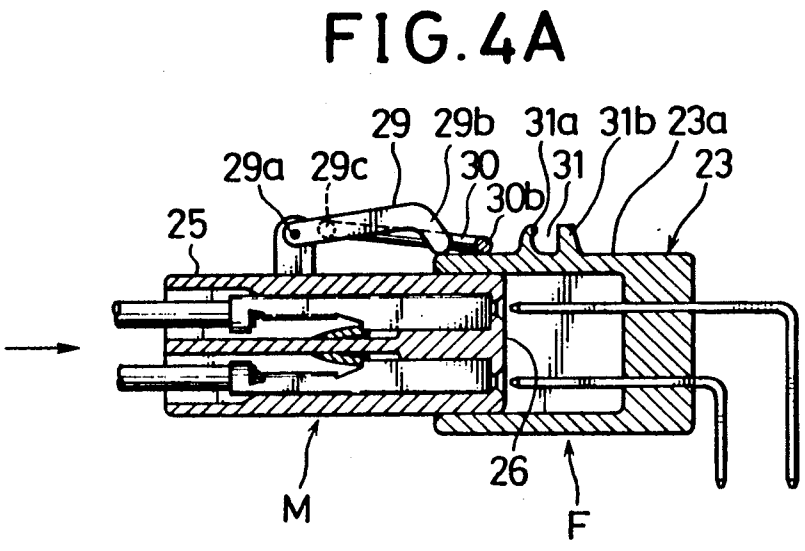
Figure 4B:
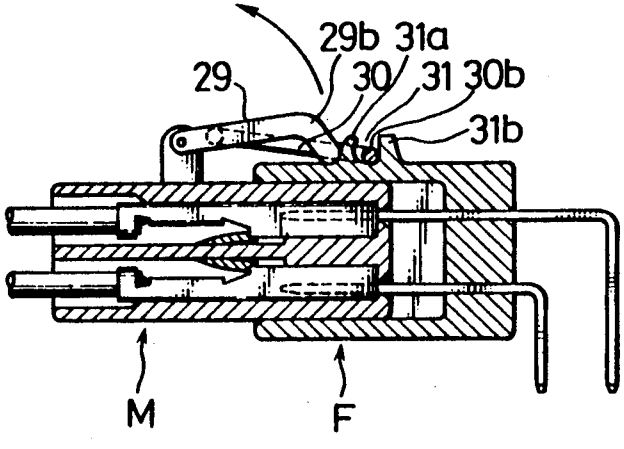

After that, when the engaging portion 30*b* of the engaging arm 30 reaches a position immediately over the groove 31 of the female connector F, the engaging portion 30*b* of the engaging arm 30 is moved downward and inserted into the groove 31, as shown in FIG. 4B. Under such circumstances, when the operating portion 29*b* of the operating lever 29 is manually rotated counterclockwise by the user (with a small driving force) as shown in FIG. 4C, the male connector M is inserted into the female connector F so as to be connected therewith with a large engaging force exerted by a toggle mechanism constructed of: the male connector M partially inserted into the female connector F; the operating lever 29 pivoted to the male connector M at the mounting portions 28 of the connector M; the ring-like engaging arm 30 which has its opposite ends pivoted to the operating lever 29 at the positions of the holes 29*c* of the lever 29 and has its engaging portion 30*b* inserted into the groove 31 of the female connector F; and the female connector F.

As is clear from FIG. 4D, this connecting operation of the male connector M with the female connector F is completed when the operating portion 29*b* of the lever 29 pivoted to the female connector F is brought into contact with the upper surface 25*a* of the peripheral wall 25 of the male connector M.

In separating or disconnecting operation of the connectors F and M having been connected with each other as described above, as shown in FIGS. 5A, 5B and 5C, the operating portion 29*b* of the lever 29 is manually rotated clockwise by the user until the portion 29*b* is brought into contact with the upper surface 23*a* of the hood portion 23 of the female connector F.

Figure 5C:
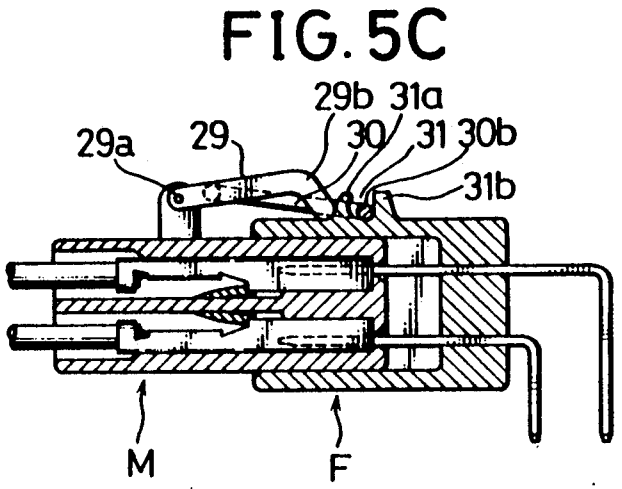
FIGS. 5A, 5B, 5C and 5D are views similar to FIG. 3, illustrating disconnection operation of the connectors of the present invention shown in FIG. 2.
Figure 5D:
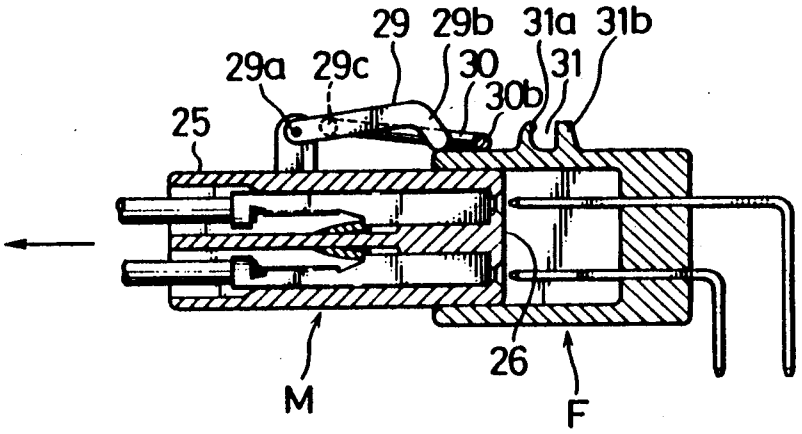
Figure 5A:
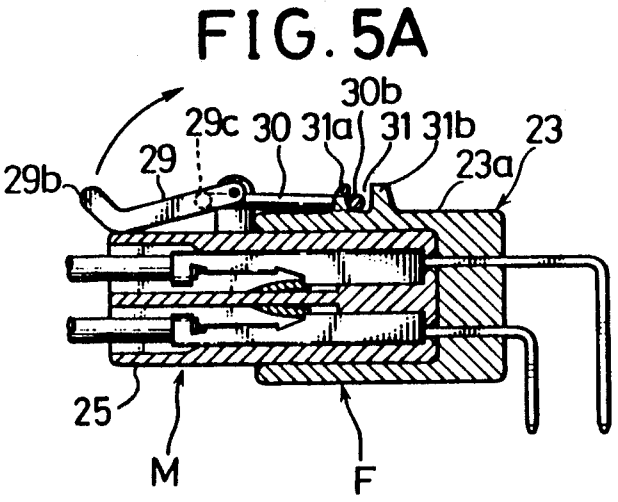
Figure 5B:
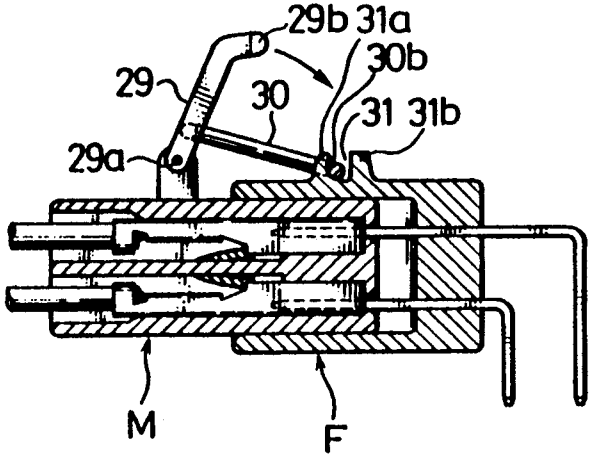

More particularly, in this disconnecting operation, as shown in FIG. 5B, after the engaging portion 30*b* of the engaging arm 30 abuts on the abutting projection 31*b* of the female connector F, the male connector M is partially disconnected or separated from the female connector F with a small effort by the user since the engaging portion 30*b* of the arm 30 pushes the abutting projection 31*b* of the female connector F rightward (as viewed in FIGS. 5B and 5C) with a large force exerted by the above toggle mechanism as the operating lever 29 is rotated clockwise by the user.

After that, as is clear from FIG. 5C, the user pulls up the engaging portion 30*b* of the arm 30 to enable the engaging portion 30*b* to clear the hook projection 31*a* of the female connector F when the male connector M is further moved leftward (as viewed in FIG. 5C) relative to the female connector F, and moves the male connector M leftward relative to the female connector F to complete the disconnecting operation of the connectors M and F, as shown in FIG. 5D.

Consequently, in the first embodiment of the connectors M, F of the present invention described above, it is possible for the user to perform connection and disconnection of the connectors F, M with a small effort without using the operating lever 29 unless the male terminals 24 of the female connector F are brought into contact with the corresponding female terminals 27 of the male connector M. In connecting and disconnecting operation of the connectors F and M in a condition in which the male terminals 24 of the female connector F are already brought into contact with the corresponding female terminals 27 of the male connector M to produce a large resistance to the connecting and disconnecting operation, it is possible for the user to overcome such large resistance to the connecting and disconnecting operation of the connectors F and M with a small effort by means of the above toggle mechanism operated through the operating lever 29.

Now, a second embodiment of the connectors F, M of the present invention will be described with reference to FIG. 6 which is a longitudinal sectional view of the second embodiment, taken along the vertical plane.

Figure 6:
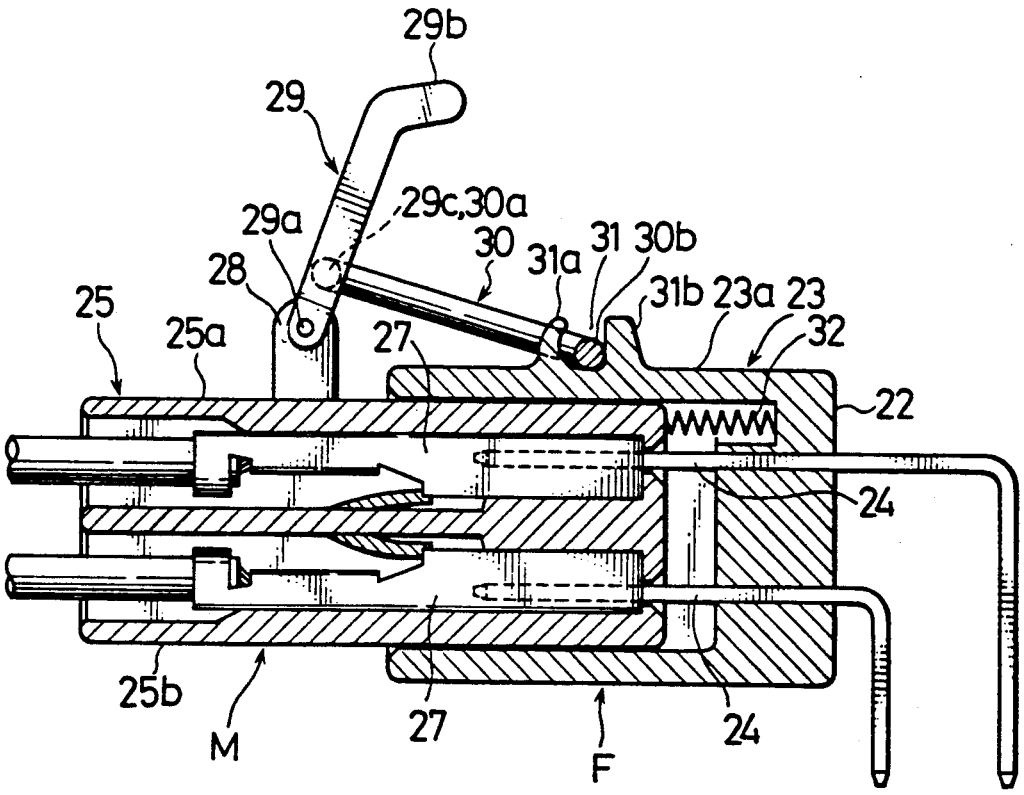
FIG. 6 is a view similar to FIG. 3, illustrating a second embodiment of the connectors of the present invention.

As shown in FIG. 6, the second embodiment of the present invention has the substantially same construction as that of the first embodiment of the present invention having been described above. Namely, in the second embodiment, the male connector M is provided with the plurality of the female terminals 24, while the female connector F is provided with the plurality of the male terminals 27.

The second embodiment of the present invention is different from the first embodiment of the present invention in the following point:

Namely, in contrast with the female connector F of the first embodiment of the present invention, the female connector F of the second embodiment of the present invention is provided with suitable biasing means such as a compression spring 32 and the like.

For example, the compression spring 32 and the like serving as the biasing means has: one of opposite ends thereof mounted fixedly in the bottom wall 22 of the hood portion 23 of the female connector F; and the other of the opposite end abut on a front-end surface of the male connector M when the connectors F, M are connected with each other, so as to keep the front-end surface of the male connector M parallel to a corresponding inner surface of the bottom wall 22 of the female connector F. As is clear from FIG. 6, the compression spring 32 extends in a direction parallel to the insertion direction of the male connector M into the hood portion 23 of the female connector F.

By the provisions of such biasing means, the second embodiment of the present invention is improved in smoothness in connecting and disconnecting operation of the connectors F, M relative to the first embodiment of the present invention. Particularly, in disconnecting operation, a biasing force exerted by the biasing means decreases the user's effort required to be applied to the operating lever 29 so as to disconnect the connectors F, M, since such biasing force acts in a direction in which the connectors F, M are separated from each other.

Incidentally, in each of the above first and second embodiments of the present invention, although the operating lever 29 is provided in the male connector M while the groove 31 is provided in the female connector F, it is also possible to provide: the operating lever 29 in the female connector F; and the groove 31 in the male connector M, respectively.

In addition, although the biasing means such as the compression spring 32 and the like is provided in the female connector F in the second embodiment of the present invention as described above, it is also possible to provide such biasing means in the male connector M.

What is claimed is:

1. A pair of connectors for electrically connecting a first terminal with a second terminal which are electrically connected with corresponding wires thereof, comprising:

a first connector holding said first terminal;

a second connector, having a first wall thickness, being connected with said first connector in a detachable manner, holding said second terminal which is connected with said first terminal in a detachable manner, said first connector slidably inserted into said second connector along a substantially linear path;

a manual operating lever for connecting and disconnecting said first connector and said second connector, provided with a base-end portion and a free-end portion, said base-end portion being pivotably connected to mounting means which extend from said first connector a distance at least equal to said first wall thickness, the lever being rotatable in a plane parallel to a direction in which said first connector is so moved as to be inserted into said second connector, whereby said first connector is connected and disconnected with said second connector in a direction substantially parallel to the direction of insertion of said first connector with said second connector;

an engaging arm provided with a base-end portion and a free-end portion formed into an engaging portion, said base-end portion of said engaging arm being rotatably mounted on said manual operating lever in an intermediate portion of said manual operating lever between said base-end portion of said manual operating lever and said free-end portion of said manual operating lever; and engaging means for being releasably engaged and disengaged with said engaging portion of said engaging arm, said engaging means being provided in said second connector; said engaging means including a hook portion for catching said engaging portion of said engaging arm, and an abutting portion on which said engaging portion of said engaging arm abuts, said engaging arm being substantially parallel to the outer periphery of the second connector in the fully engaged position, said engaging portion of said engaging arm being urged with a controlled force against said abutting portion for disengaging said second connector from said first connector along a direction substantially parallel to the direction of insertion of said first connector with said second connector; and a biasing means for biasing said connectors in a direction in which said connectors are separated from each other so that said connectors are constrained to a substantially parallel orientation relative to the insertion direction during the connecting and disconnecting operation.

2. The pair of the connectors according to claim 1, wherein:

each of said hook portion and said abutting portion of said engaging means includes a projection provided in said second connector, said hook portion being spaced apart from said abutting portion to form an engaging groove therebetween for receiving said engaging portion of said engaging arm therein.

3. The pair of the connectors according to claim 1, wherein:

said biasing means includes a spring member mounted to said first connector.

4. The pair of the connectors according to claim 1, wherein:

said biasing means includes a spring member mounted to said second connector.

5. A pair of connectors for electrically connecting a first terminal with a second terminal which are electrically connected with corresponding wires thereof, comprising:

a first connector holding said first terminal;

a second connector, having a first wall thickness, being connected with said first connector in a detachable manner, holding said second terminal which is connected with said first terminal in a detachable manner with a retention force therebetween, said first connector slidably inserted into said second connector along a substantially linear path;

a manual operating lever for connecting and disconnecting said first connector and said second connector, provided with a base-end portion and a free-end portion, said base-end portion being pivotably connected to mounting means which extend from said first connector a distance at least equal to said first wall thickness, the lever being rotatable in a plane parallel to a direction in which said first connector is so moved as to be inserted into said second connector, whereby said first connector is connected and disconnected with said second connector in a direction substantially parallel to the direction of insertion of said first connector with said second connector;

an engaging arm provided with a base-end portion and a free-end portion formed into an engaging portion, said base-end portion of said engaging arm being rotatably mounted on said manual operating lever in an intermediate portion of said manual operating lever between said base-end portion of said manual operating lever and said free-end portion of said manual operating lever; and engaging means for being releasably engaged and disengaged with said engaging portion of said engaging arm, said engaging means being provided in said second connector; said engaging means including a hook portion for catching said engaging portion of said engaging arm, and an abutting portion on which said engaging portion of said engaging arm abuts, said engaging arm being substantially parallel to the outer periphery of the second connector in the fully engaged position, said engaging portion of said engaging arm being urged with a controlled force against said abutting portion for disengaging said second connector from said first connector along a direction substantially parallel to the direction of insertion of said first connector with said second connector;

wherein the controlled force for disengaging said second connector from said first connector causes a leveraged separation of the first terminal from the second terminal by overcoming the retention force therebetween.

6. A pair of connectors for electrically connecting a first terminal with a second terminal which are electrically connected with corresponding wires thereof, comprising:

a first connector holding said first terminal;

a second connector, having a first wall thickness, being connected with said first connector in a detachable manner, holding said second terminal which is connected with said first terminal in a detachable manner, said first connector slidably inserted into said second connector along a substantially linear path;

a manual operating lever for connecting and disconnecting said first connector and said second connector, provided with a base-end portion and a free-end portion, said base-end portion being pivotably connected to mounting means the lever being rotatable in a plane parallel to a direction in which said first connector is so moved as to be inserted into said second connector, whereby said first connector is connected and disconnected with said second connector in a direction substantially parallel to the direction of insertion of said first connector with said second connector;

an engaging arm provided with a base-end portion and a free-end portion formed into an engaging portion, said base-end portion of said engaging arm being rotatably mounted on said manual operating lever in an intermediate portion of said manual operating lever between said base-end portion of said manual operating lever and said free-end portion of said manual operating lever; and engaging means for being releasably engaged and disengaged with said engaging portion of said engaging arm, said engaging means being provided in said second connector; said engaging means including a hook portion for catching said engaging portion of said engaging arm, and an abutting portion on which said engaging portion of said engaging arm abuts, said engaging arm being substantially parallel to the outer periphery of the second connector in the fully engaged position, said engaging portion of said engaging arm being urged with a controlled force against said abutting portion for disengaging said second connector from said first connector along a direction substantially parallel to the direction of insertion of said first connector with said second connector; and a biasing means for biasing said connectors in a direction in which said connectors are separated from each other so that said connectors are constrained to a substantially parallel orientation relative to the insertion direction during the connecting and disconnecting operation.

* * * * *